United States Patent [19]

Oh

[11] Patent Number: 4,968,268

[45] Date of Patent: Nov. 6, 1990

[54] ELECTRIC WIRE CONNECTING DEVICE

[75] Inventor: Un S. Oh, Kyungki, Rep. of Korea

[73] Assignee: SamSung Electronics Co., Ltd., Kyung Ki-Do, Rep. of Korea

[21] Appl. No.: 395,505

[22] Filed: Aug. 18, 1989

[30] Foreign Application Priority Data

Aug. 23, 1988 [KR] Rep. of Korea ..... 13732/1988

[51] Int. Cl.[5] ..... H01R 4/24

[52] U.S. Cl. ..... 439/411; 439/425; 439/431

[58] Field of Search ..... 439/389, 409–419, 439/421, 425, 426, 431

[56] References Cited

U.S. PATENT DOCUMENTS

| | | | |
|---|---|---|---|
| 1,287,542 | 12/1918 | Whitney | 439/414 |
| 2,934,737 | 4/1960 | Gibson | 439/412 |
| 3,016,510 | 1/1962 | Blonder | 439/411 |
| 3,509,517 | 4/1970 | Gutehall | 439/411 |
| 3,701,839 | 10/1972 | Smith | 439/411 |

FOREIGN PATENT DOCUMENTS

| | | | |
|---|---|---|---|
| 1909586 | 9/1970 | Fed. Rep. of Germany | 439/411 |
| 2456401 | 1/1981 | France | 439/411 |

*Primary Examiner*—David L. Pirlot

*Attorney, Agent, or Firm*—Robert E. Bushnell

[57] ABSTRACT

An electric wire connecting device for connecting an electric wire or TV antenna feeder wire to a receptacle or terminals only by the tightening action of the device which passes a blade provided within the connecting device through the insulation cover layer so as to be contacted directly with the conductive wire core made normally of copper wire, so that electrical connection can be obtained. The invention is comprised of: basic body (1) and blade (1*a*) standing erect from the body, a pair of pressing pieces (1*b*) bent inwardly at both end edge portions, a pair of anti-motion pieces (1*c*) bent inwardly at both end edge portions and diverging from said pressing pieces with a predetermined cut out portion therebetween, and a stopper coupling groove (1*d*) defined by a cutout at a central portion of the rear edge of the body for coupling with a mating protrusion so as not to rotate with screwing of the tightening screw.

7 Claims, 2 Drawing Sheets

Fig- 3A
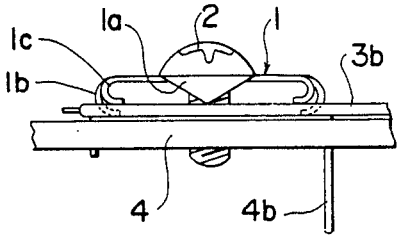
Fig- 3B
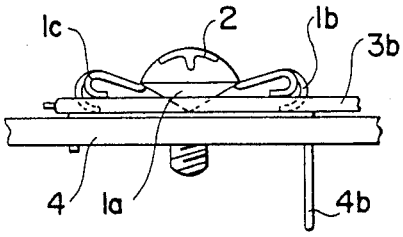
Fig- 4A
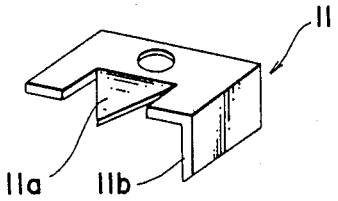
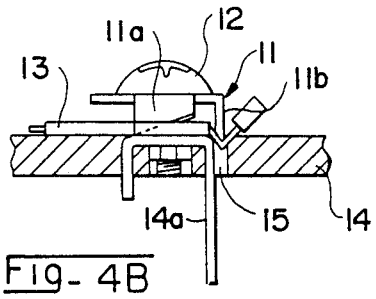
Fig- 4B
Fig- 5
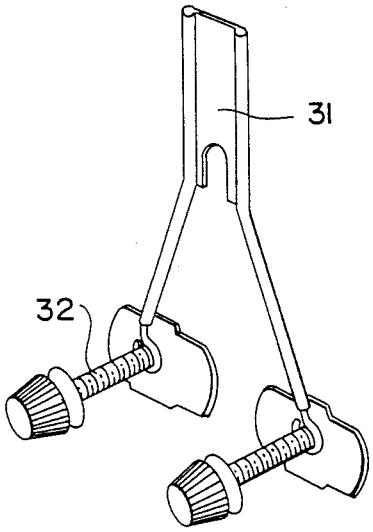

ELECTRIC WIRE CONNECTING DEVICE

BACKGROUND OF THE INVENTION

The present invention relates to an electric wire connecting device for use in, for example, fixing the antenna feeder wire of TV or connecting the electric wire to a receptacle, and particularly, to an electric wire connecting device wherein a blade edge penetrates the wire cover layer only by the action of screwing in the terminal bolt or screw so that it can be directly connected electrically with conductive wire (copper wire) therein.

In conventional the case of either connecting an electric wire to a receptacle or connecting an TV antenna feeder wire to TV main body, as shown in FIG. 5, after removing the cover layer of the end portion of the electric wire 31 or antenna feeder wire, winding this to a screw 32 or bolt for the electric wire connection and then screwing it, and thereby connecting its some tool such as a nipper or knife is required for removing the cover layer. If it has not been stripped off cleanly in a skilled manner, the electric wire is liable either to be turned in idle according to the turning of screw or to be cut off upon winding it and screwing the screw or bolt, and therefore, there has been a problem in that the operation is troublesome.

OBJECT OF THE INVENTION

Therefore, it is an object of the present invention to provide an electric wire connecting device capable of connecting the electric wire easily to the receptacle and the like by including a connecting member for making electric connection which is interposed between the electric wire and head of the screw, and a blade formed on the body penetrates the cover layer of the electric wire and contacts the conductive core wire by the screwing action of the screw or bolt in order to solve such problems as aforementioned.

The foregoing and other objects as well as advantages of the present invention will become clear by the following description of the invention with reference to the accompanying drawings.

BRIEF DESCRIPTION OF THE DRAWINGS

For a better understanding of the present invention, and to show how the same may be carried out into effect, reference will now be made, by way of example, with respect to the accompanying drawings, in which:

FIGS. 2A, 2B and 2C are diagrams for showing the applying condition of the present invention, in which FIG. 2A is a plane view for showing the applying condition of the invention, FIG. 2B is a cross sectional view taken along the line A—A of FIG. 2A, FIG. 2C is a side view for showing the applying condition of the invention, FIGS. 3A and 3B are cross sectional view for showing the operational condition of the present invention, in which FIG. 3A is a cross sectional view for showing a condition before contacting or connecting, FIG. 3B is a cross sectional view for showing a contacted or connected condition, FIGS. 4A and 4B are diagrams of another embodiment of the present invention, in which FIG. 4A is a perspective view of connecting member of another embodiment, FIG. 4B is a cross sectional view for showing a connected or contacted condition of another embodiment, and FIG. 5 is a perspective view for showing the applying state of a conventional device.

Throughout the drawings, like reference numerals and symbols are used for designating like or equivalent parts or portions, for simplicity of illustration and explanation.

DESCRIPTION OF THE PREFERRED EMBODIMENT

A preferred embodiment of the present invention will be described in detail with reference to the accompanying drawings hereinafter.

Figure 1:
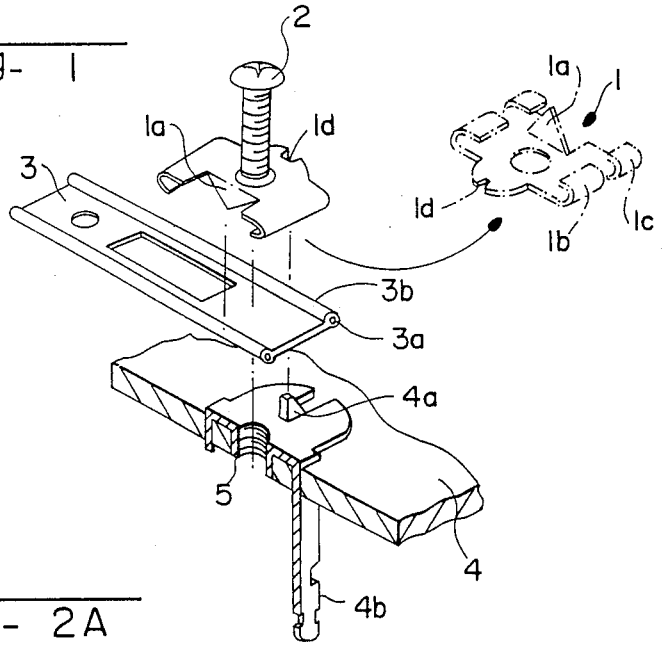
FIG. 1 is an exploded perspective view of a preferred embodiment of the present invention.

As shown in FIG. 1, the present invention, in connecting the antenna feeder wire or electric wire 3 to a terminal board 4 or to a receptacle, can accomplish the desired object by a pair of connecting members 1 which is connected electrically together with the terminal board with serving as a washer between the electric wire and the terminal screw 2.

The pair of connecting members 1 are formed integrally with acute blade **1*a* bent vertically at a central portion of the body of member, and a pair of anti-motion pieces 1*c* which are connected with conductive terminal base of the terminal board, at the same time, both of the right and left end edge portions of connecting member are bent in order to prevent the inclination of the connecting member, and a pair of pressing pieces 1*b* of symmetrical form which are bent inwardly and defining predetermined cut out portions between the anti-motion pieces 1*c* and pressing pieces 1*b*, respectively, and pressing both sides of the blade penetrating portion of the electric wire so as to easily penetrate the cover layer 3*b* of the electric wire with blade 1*a*** of the connecting member upon connecting the electric wire.

Figure 2A:
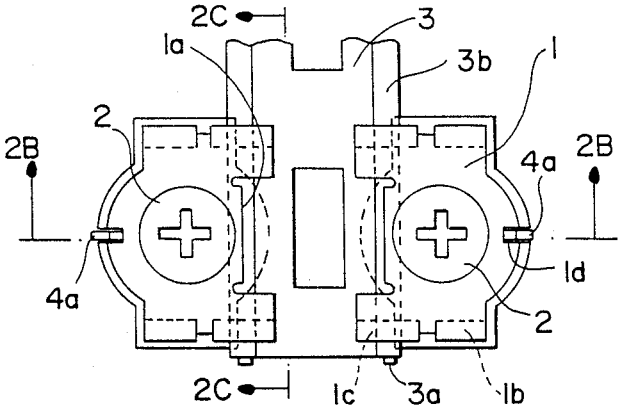
Figure 2B:
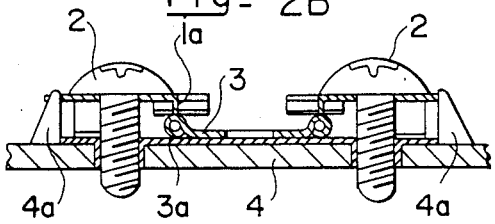
Figure 2C:
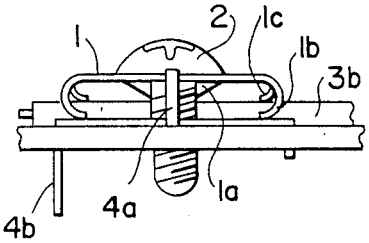

And, a coupling groove **1*d* is formed at the central portion of the rear side edge of connecting member 1 in order to prevent the turning of connecting member 1 together with screw upon screwing a terminal screw 2 or bolt for the electrical connection so as to be inserted with stopper 4*a* protruded on the terminal board 4. Therefore, in the case when it is desired to connect electrically the electric wire 3 to the terminal board 4, as shown in FIGS. 2 and 3, after loosening up the terminal screw 2 a distance corresponding to the thickness of the electric wire, and inserting in the electric wire 3 between the connecting member 1 and the base terminal 4*b* of the terminal board 4, and screwing the terminal screw 2, as shown in FIG. 3A, the pressing pieces 1*b* and anti-motion pieces 1*c* of symmetrical form being bent at both sides of the connecting member 1, press simultaneously the electric wire 3 to fix it firmly. By subsequent screwing action of the screw 2, as shown in FIG. 3B, the blade 1*a* of connecting member 1 penetrates the cover layer 3*b* of the electric wire 3, and as the terminal screw 2 is being tightened by screwing into the nut boss 5 as well as the terminal base 4*b*, the conductive wire core (usually copper wire core) 3*a* within the cover layer 3*b* of the electric wire 3 is contacted with blade 1*a* of the connecting member 1, and thereby becoming connected electrically with the terminal base 4*b***.

Thus, as the screwing operation proceeds, in order to prevent the connecting member 1 being turned together with the turning action of the screw 2, the stopper 4*a* protruded on the terminal board 4 is made to be coupled to the stopper coupling groove 1*d* formed to the connecting member 1, so that simultaneous turning of the connecting member 1 can be prevented.

On the other hand, in another embodiment of the present invention, as shown in FIG. 4, instead of the pressing pieces 1*b* and the anti-motion pieces 1*c* of symmetric being bent at both sides of the connecting member of a preferred embodiment, this embodiment has another blade 11*b* bent perpendicularly with its one end edge so as to cross at a right angle with a blade 11*a* of connecting member 11, a vacant space 15 is formed to the terminal board 14, and terminal base 14*a* is fixed thereto. The electric wire 13 is interposed between the terminal board 14 and the connecting member 11, and when it is pressed by tightening with terminal screw 12, the blade 11*a* formed integrally to said contacting member 11 is contacted with the electrically conductive wire (copper wire) within the cover layer by penetrating the cover layer of the electric wire, and the blade 11*b* and the electric wire 13 are inserted by pressing into said inserting groove 15 of said connecting terminal by the subsequent tightening action, so that the electrical connection can be obtained in double with the terminal base 14*a* of the terminal board 14. That is to say, the connecting member 11 is formed such that blade 11*a* and the blade 11*b* are provided perpendicularly each other, and when the electric wire 13 is inserted between the connecting member 11 and the terminal base 14*a*, and the terminal screw 12 is tightened by screwing in, and the top end of the connecting member 11 is pressed, one of the blades 11*a* penetrates the insulation cover layer in a direction of the electric wire so that the electrical connection is obtained, and at the same time, another blade 11*b* presses the electric wire perpendicular to the direction of the electric wire, and it is stripped by the blade at the vacant space 15 of said terminal board, and the electrical connection is established at two locations.

According to above embodiment of the present invention, in an article having a structure for connecting electrically the electric wire to the connecting terminal such as a plug or receptacle, antenna terminal board of TV or audio equipment and the like, since the electric wire can be electrically connected with the terminal board only by a tightening action of a simple screw of the connecting member 1, 11 of the invention without executing any removing work of the cover layer of the electric wire, there is advantage that wiring work can be carried out very simply.

It will be appreciated that the present invention is not restricted to the particular embodiment that has been described hereinbefore, and that variations and modifications may be made therein without departing from the spirit and scope of the invention as defined in the appended claims and equivalents thereof.

What is claimed is:

1. An electric wire connecting device, comprising:

a conductive connecting member providing a washer function for a terminal screw in connecting electrically the electric wire;

a first blade to extend bent erectly from a body of the connecting member so that the electrical connection can be obtained by causing said blade to penetrate an insulation cover layer of the electric wire only by the tightening action of the terminal screw;

a pair of means for pressing both sides of a connecting portion of the electric wire by bending both end edge portions of right and left sides of the body inwardly and spaced apart from said body;

a pair of anti-motion pieces made of electrically conductive material with, a terminal base maintaining the connecting member horizontally at a predetermined distance from said pressing means, said pressing means and anti-motion pieces having inwardly turned resilient ends terminating at different distances from said body; and coupling groove means for coupling with a stopper protruded from a terminal board to prevent the turning of the connecting member together with turning of the screw upon screwing the terminal screw for the electrical connection of the connecting member with terminal board.

2. An electric wire connecting device according to claim 1, wherein said electrically conductive connecting comprises a discrete pair of elements applied as a set for the electrical connection of the connecting member with the terminal board.

3. An electric wire connecting device according to claim 1, wherein said pressing means and anti-motion pieces are bent with said resilient ends integral with and separated by respective rounded sections from said body, wherein said pressing means press the electric wire and the anti-motion pieces contact the terminal base, whereby the connecting member can be maintained in a planar surface.

4. An electric wire connecting device according to claim 1, further comprising a blade bent to extend erectly with one end edge of said connecting member crossing at a right angle to said acute blade without said inwardly bent portions, so that the electrical connection can be obtained in double.

5. An electric wire connecting device, comprising:

a conductive connecting member having blades bent downwardly to a predetermined length and sharpened with tip ends formed at any one side of the front and rear portions of a rectangular plate perforated with a hole at the center of a planar base, and a pair of pressing pieces bent with different height from one another with anti-rotational pieces respectively formed at remaining sides, and a terminal member having a nut boss formed on the center of a planar terminal member base and a terminal which is formed to extend downwardly, said terminal member and connecting member being coupled by screwing a screw into the hole centered on the planar base of said conductive member and a nut member of the terminal member, whereby electric wire having a conductive wire core covered by an insulating layer is perforated by said blades.

6. The electric wire connecting device according to claim 5, further comprised of said conductive member and terminal member being both respectively formed as a pair.

7. The electric wire connecting device according to claim 5, further comprised of a coupling recess formed by cutting out the planar base at any one side of front and rear portions of said conductive connecting member, whereby the coupling is formed to protrude on the plane base of said terminal member, and the conductive connecting member is made to prevent the reverse turning while coupling the terminal member and the conductive connecting member during tightening of said connecting member and said terminal member.

* * * * *